US011454468B1

(12) United States Patent
Li et al.

(10) Patent No.: US 11,454,468 B1
(45) Date of Patent: Sep. 27, 2022

(54) RECOIL BUFFER ASSEMBLY

(71) Applicant: J&E Machine Tech, Inc., Rancho Cucamonga, CA (US)

(72) Inventors: Yiyang Li, Rancho Cucamonga, CA (US); Yun Chang, Rancho Cucamonga, CA (US)

(73) Assignee: J&E MACHINE TECH, INC., Rancho Cucamonga, CA (US)

( * ) Notice: Subject to any disclaimer, the term of this patent is extended or adjusted under 35 U.S.C. 154(b) by 0 days.

(21) Appl. No.: 17/208,158

(22) Filed: Mar. 22, 2021

(51) Int. Cl.
*F41A 3/84* (2006.01)
*F41A 3/78* (2006.01)

(52) U.S. Cl.
CPC ..... *F41A 3/84* (2013.01); *F41A 3/78* (2013.01)

(58) Field of Classification Search
CPC ..... F41A 3/70; F41A 3/78; F41A 3/80; F41A 3/84
See application file for complete search history.

(56) References Cited

U.S. PATENT DOCUMENTS 2,361,180 A 10/1944 Dobremysl
2,779,249 A * 1/1957 Saetter-Lassen ..... F41C 23/06 89/198
3,298,282 A 1/1967 Loffler et al.
3,363,351 A * 1/1968 Smith ..... F41A 3/82 89/197
3,366,011 A 1/1968 Sturtevant
3,381,405 A 5/1968 Edwards
3,731,590 A 5/1973 Zimmerman
4,126,080 A 11/1978 Reynolds
4,344,352 A 8/1982 Yates et al.
4,485,723 A * 12/1984 Sarony ..... F41A 3/86 89/198
4,522,107 A 6/1985 Woodcock et al.
5,054,368 A * 10/1991 Wentzel ..... F41A 3/86 89/196
5,127,310 A * 7/1992 Lishness ..... F41A 3/86 42/108
5,309,815 A * 5/1994 Moller ..... F41A 3/86 89/196
5,581,046 A * 12/1996 Weldle ..... F41A 3/86 89/196
5,827,992 A 10/1998 Harris et al.
5,909,002 A * 6/1999 Atchisson ..... F41A 3/70 42/1.06
6,758,126 B1 * 7/2004 Houtsma ..... F41A 3/94 42/1.06

(Continued)

*Primary Examiner* — Joshua E Freeman
(74) *Attorney, Agent, or Firm* — Stetina Brunda Garred & Brucker

(57) ABSTRACT

A captured spring recoil buffer has a rod with a flanged rear end and a shaft defining a pin passage slot. An action spring is fitted around the rod and is defined by a forward end and a rear end abutting against the flanged rear end of the rod. A buffer has a cylindrical sidewall and defines an axial bore, with the cylindrical sidewall further defining a pair of aligned crosswise pin openings normal to the bore axis. The buffer is in sliding engagement with the rod, and the forward end of the action spring abuts against the buffer. A dowel pin is positioned through the crosswise pin openings on the cylindrical sidewall of the buffer and through the pin passage slot of the shaft.

19 Claims, 5 Drawing Sheets

(56) References Cited

U.S. PATENT DOCUMENTS

| | | | | |
|---|---|---|---|---|
| 7,493,845 | B2 * | 2/2009 | Mantas | F41A 3/86 42/1.06 |
| 8,430,015 | B2 | 4/2013 | Faifer | |
| 8,800,424 | B2 * | 8/2014 | Gangl | F41A 3/84 89/198 |
| 8,899,141 | B2 * | 12/2014 | Reynolds | F41A 5/12 89/129.01 |
| 9,915,492 | B2 | 3/2018 | Huang | |
| 10,323,891 | B1 * | 6/2019 | Zheng | F41A 3/84 |
| D864,337 | S * | 10/2019 | Iosilevsky | D22/108 |
| 10,619,955 | B2 * | 4/2020 | Wyssen | F41A 3/82 |
| 10,619,956 | B1 * | 4/2020 | Zhang | F41A 3/84 |
| 10,775,121 | B2 * | 9/2020 | Bender | F41A 3/84 |
| 10,794,647 | B2 * | 10/2020 | Lage | F41A 3/26 |
| 2006/0236853 | A1 * | 10/2006 | Boersching | F41A 3/70 89/198 |
| 2013/0319217 | A1 * | 12/2013 | Gangl | F41A 3/84 89/198 |
| 2014/0059909 | A1 * | 3/2014 | Caudle | F41A 3/84 42/1.06 |
| 2017/0321978 | A1 * | 11/2017 | Brannan | F41A 3/70 |
| 2018/0274870 | A1 * | 9/2018 | Law | F41A 3/82 |
| 2019/0017765 | A1 * | 1/2019 | Bender | F41A 19/44 |
| 2019/0383571 | A1 * | 12/2019 | Wyssen | F41A 3/82 |
| 2021/0156633 | A1 * | 5/2021 | Durham, III | F41A 3/82 |

* cited by examiner

RECOIL BUFFER ASSEMBLY

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates generally to firearms, and more particularly, to a recoil buffer assembly for use with a reciprocating bolt firearm.

2. Related Art

A modern sporting rifle refer to a broad class of semiautomatic, magazine-fed, intermediate caliber firearms, and are popular with a wide range of ownership constituencies due to their modularity, accuracy, light weight, and adaptability to various applications including self-defense, hunting, as well as competitive and recreational target shooting, among many others. Although different model firearms fall under the category of modern sporting rifles, the most common is the AR-15 variant, so called because of its lineage to the Armalite Rifle (AR)-15 design.

An AR-15-type rifle is comprised of a number of modular base components generally segregated into a lower receiver group and an upper receiver group. The lower receiver group is comprised of a lower receiver with various modular components installed thereon. Specifically, the lower receiver defines a magazine well that accepts ammunition magazines, and includes a retention catch/release button. The lower receiver also houses the fire control group, which includes the trigger, the hammer, the sear, the disconnect, the safety, and accompanying springs, detents, and retention pins. There is also a bolt catch that is connected to an externally accessible bolt release. Toward the rear end of the lower receiver there is defined a buffer tube receiver extension, to which a buffer tube is threadably engaged. A fixed or an adjustable buttstock is attached to the buffer tube, and also attached to the lower receiver is a pistol grip.

The upper receiver group is generally comprised of the upper receiver and the barrel, with a bolt carrier group that reciprocates within the upper receiver along the central axis of the barrel. The upper receiver group is coupled and pinned to the lower receiver group to complete the assembly of the firearm. With a magazine loaded with ammunition cartridges are inserted into the magazine well and secured to the lower receiver, a charging handle engaged to the bolt carrier is pulled rearward, then released. On the forward travel of the bolt carrier group, a fresh ammunition cartridge is stripped off of the magazine and forced into the chamber defined within the barrel. The bolt carrier group is comprised of a bolt located within a bolt carrier, along with a firing pin that extends through both and retained with a pin. The bolt is in a reciprocating relationship with the bolt carrier and has an extended position and a retracted position. The bolt is in the extended position as the ammunition cartridge is chambered. The forward travel of the bolt is limited by the cartridge that has been chambered, but the bolt carrier continues its forward travel. A cam pin that links the bolt to the bolt carrier travels within a partially spiral groove, which then rotates the bolt to lock the cartridge into the chamber.

Upon the trigger being pressed, the hammer is released and travels forward to strike the firing pin, which in turn strikes the primer on the cartridge that ignites the gunpowder. The bullet is propelled through the barrel from the expanding gasses, and a part of this gas is bled into a gas tube tapped from a forward location on the barrel. The gas returns to the bolt carrier group (and specifically the bolt carrier key to which the gas tube is engaged), forcing the bolt to rearward to unlock from the barrel. The extractor claw on the bolt maintains engagement with the cartridge rim and withdraws the cartridge from the chamber. With the bolt/cartridge reaching a predefined point of travel after the spent cartridge no longer being in engagement with the chamber wall, the force of the ejector within the bolt rotates the cartridge outwardly towards the ejection port, removing it from within the receiver.

The bolt carrier group continues along its rearward path and pushes against a weighted buffer that reciprocates within an interior of the buffer extension tube. An action spring located within the buffer extension tube resists this rearward force, slowing down travel until the biasing force is no longer being overcome. The bolt carrier then begins its forward/return travel, stripping a new cartridge case on its path to repeat the forgoing operations. If the magazine is empty, the upward force of the magazine spring pushes the follower against the bolt catch, which retains the bolt carrier group in the rearward position.

Again, the popularity of the modern sporting rifle, and particularly AR-15 variants, is largely due to the modularity of the platform. One upper receiver group can be quickly swapped with another while using the same lower receiver group, the caliber of the rounds fired may be changed by changing the bolt, magazine, and barrel, and a different pistol grips and buttstocks may be swapped for different ones that are particular to the operator's preference. Indeed, there are aftermarket versions of each of the aforementioned components.

It is necessary to tune the speed and deceleration of the bolt carrier group during its rearward travel, as well as the speed and acceleration of the same during its forward travel. For example, if the rearward travel is not optimized, extraction and/or ejection may be inconsistent, and if the forward travel is not optimized, feeding may be inconsistent, with either case resulting in stoppages. Further, incorrectly tuned actions may increase felt recoil. The optimal tuning may depend the length of the barrel, the bullet and powder grain weight, the diameter of the opening on the barrel to bleed off gas, and whether or not a suppressor is being used. One way to tune the action is changing the weight of the buffer, while another is changing the weight of the action spring. As with almost all components of an AR-15 style rifle, the buffer extension tube, the buffer and the action spring have been standardized, though into one of two configurations—rifle length, and carbine length.

The standard buffer, buffer extension tube, and action spring configuration, and its many aftermarket variations, may be inadequate under some circumstances. The large action spring tends to move around within the buffer extension tube and rub against the side walls, particularly while cycling. In response, captured spring buffer assemblies that entirely replace the standard configuration have been developed, utilizing multiple, axially nested rods and a movable buffer coupled together with threaded fasteners. A number of deficiencies existed with such devices, including the gradual loosening of the fasteners and a complicated/difficult reassembly procedure that must be completed under full spring force. Accordingly, there is a need in the art for an improved recoil buffer assembly.

BRIEF SUMMARY

The present disclosure contemplates various embodiments of a firearm recoil buffer assembly that minimizes noise and during cycling and allow fine tuning of the action. One embodiment contemplates a captured spring recoil buffer that may be a drop-in replacement for a buffer and action spring for an AR-pattern rifle or firearm. In accordance with such embodiment, the recoil buffer assembly may include a rod with a flanged rear end and a shaft defining a pin passage slot. There may also be an action spring fitted around the rod. The action spring may be defined by a forward end and a rear end abutting against the flanged rear end of the rod. The recoil buffer assembly may also include a buffer with a cylindrical sidewall and defining an axial bore. The cylindrical sidewall may define a pair of aligned crosswise pin openings normal to the bore axis. The buffer may be in sliding engagement with the rod and the forward end of the action spring abutting against the buffer. Additionally, there may be a dowel pin positioned through the crosswise pin openings on the cylindrical sidewall of the buffer and through the pin passage slot of the shaft.

According to another embodiment of the present disclosure, there may be a firearm recoil buffer assembly. There may be a rod with a flanged rear end, as well as a shaft extending therefrom. The recoil buffer assembly may include an action spring that is fitted around the rod, and further defined by a forward end and a rear end abutting against the flanged rear end of the rod. Additionally, the recoil buffer assembly may also include a buffer with a cylindrical sidewall defining an axial bore. The buffer may be in sliding engagement with the rod. The forward end of the action spring may abut against the buffer.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The detailed description set forth below in connection with the appended drawings is intended as a description of the several presently contemplated embodiments of a recoil buffer assembly. This description is not intended to represent the only form in which the embodiments of the disclosed invention may be developed or utilized. The description sets forth the functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second, front and rear, forward and aft, left and right, distal and proximal and the like are used solely to distinguish one from another entity without necessarily requiring or implying any actual such relationship or order between such entities.

Figure 1:
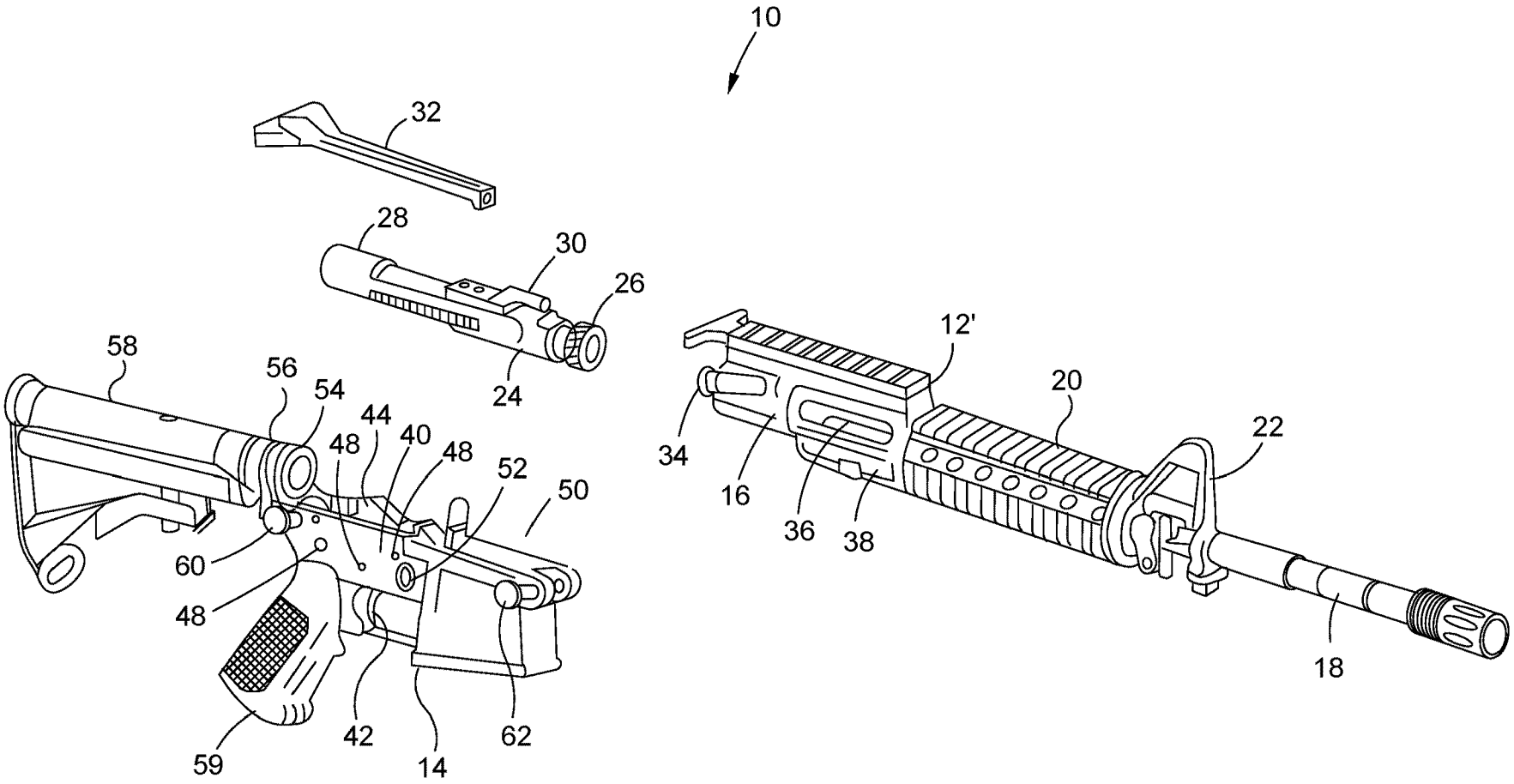
FIG. 1 is an exploded perspective view of a firearm in which various embodiments of the presently disclosed recoil buffer assembly may be utilized.

The recoil buffer assembly of the present disclosure may be utilized in self-loading, reciprocating bolt firearm 10, an exemplary embodiment of which is depicted in FIG. 1. The firearm 10 may be a commonly-owned Armalite Rifle (AR)-15 type semiautomatic rifle that is comprised of basic modular components having certain standardized configuration parameters for interchangeability, including an upper assembly 12 and a lower assembly 14.

The specifics of the firearm 10 are presented by way of example only and not of limitation, as those having ordinary skill in the art will recognize that there are numerous possible variations. For example, rather than a civilian AR-15 pattern limited to semiautomatic fire in which a single trigger pull results in a single round being fired, the rifle 10 may be capable of selective fire such as three-round burst or full automatic. Additionally, although the example embodiments of the present disclosure are described in the context of a rifle as understood under U.S. legal definitions, that is, a firearm with a buttstock having a barrel of longer than sixteen inches, pistol configurations in which there is no buttstock, short-barreled rifle configurations, and the like may be substituted without departing from the scope of the present disclosure. Along these lines, while the AR-15 style rifle generally entails chamberings of 5.56×45 mm NATO/.223 Remington rounds and other calibers that fit within the cartridge overall length limits of the same, similarly pattered firearms chambered for larger rounds such as 7.62×54 mm NATO/.308 Winchester rounds may be substituted (variously referred to as AR-10, AR-308, SR-25, etc. pattern rifles).

The upper assembly 12 includes an upper receiver 16, to which a barrel 18 is attached, and a handguard 20 that encircles the barrel 18. The handguard 20 is retained between the forward end of the upper receiver 16 and a gas block/front sight tower 22. The illustrated upper assembly 12 includes a bolt carrier group 24 that serves to chamber, fire, extract, and eject the ammunition cartridge. Although shown separated, it is understood that the bolt carrier group 12 is associated with the upper assembly 12. The illustrated example shows a gas-operated bolt carrier group 16 in which the expanding gasses tapped from a gas port on the barrel 18 is returned thereto to force it rearward. The gas block 22 positioned at such gas port, and there is an elongate gas tube extending between the gas block 22 and the upper receiver 12. The bolt carrier group 16 is more specifically comprised of a rotating bolt 26 that is coupled with a bolt carrier 28. The gas tube extends into the upper receiver 16 to engage with a gas carrier key 30 that is mounted to the bolt carrier 28. Although a gas-operated action is depicted, this is by way of example only and not of limitation. The embodiments of the present disclosure may be utilized in piston-operated actions, in either short stroke or long stroke modalities.

In order to manually operate the action, the upper assembly 12 may include a charging handle 30 as well as a forward assist 34. The operator can pull the charging handle 30 after a magazine is inserted so that a fresh round can be chambered in the return cycle of the bolt carrier group 24. To the extent the bolt does not fully lock the ammunition cartridge, the forward assist 34 can be pushed to provide the forward force to do so. The upper receiver 12 defines an ejection port 36 that may be selectively closed with an ejection port cover 38. As discussed above, a spent ammunition cartridge is ejected from the ejection port 36 as the bolt 26/bolt carrier group 24 cycles after firing.

The lower assembly 14 is generally defined by a lower receiver 40 that houses a fire control group including a trigger 42, a hammer 44, a sear (not shown) and a disconnect (not shown), together with pins 46 that rotatably fix such components to the lower receiver 40. There may be safety selector 48 is rotatable to different orientations to allow and disallow the release of the hammer 44 to fire the rifle. The lower receiver 40 further defines a magazine well 50 that accepts an ammunition magazine. Such a magazine is locked into the lower receiver 40 with a magazine catch that is releasable by pressing a magazine catch button 52. The rear end of the lower receiver 40 defines a buffer tube receiver extension 54 to which a buffer extension tube 56 is coupled. Slidably mounted to the buffer extension tube 56 is an adjustable buttstock 58 that has a locking pin that engages with a series of detent holes defined on the buffer extension tube 56 to adjust the length of pull. The buttstock 58 as particularly shown, also known as an M4A1 type, is exemplary only, and any other buttstock variation may be substituted. For instance, the buttstock 58 may be a fixed length variety without adjustment means. The buttstock 58 may also have enhanced cheek pads with underlying storage compartments such as those implemented in an improvement commonly referred to as a SOPMOD (Special Operations Peculiar MODification) stock. A pistol grip 59 is also attached to the lower receiver 40. The upper assembly 12 is mounted to the lower assembly 14 with a rear takedown pin 60 and a front pivot pin 62.

Figure 2:
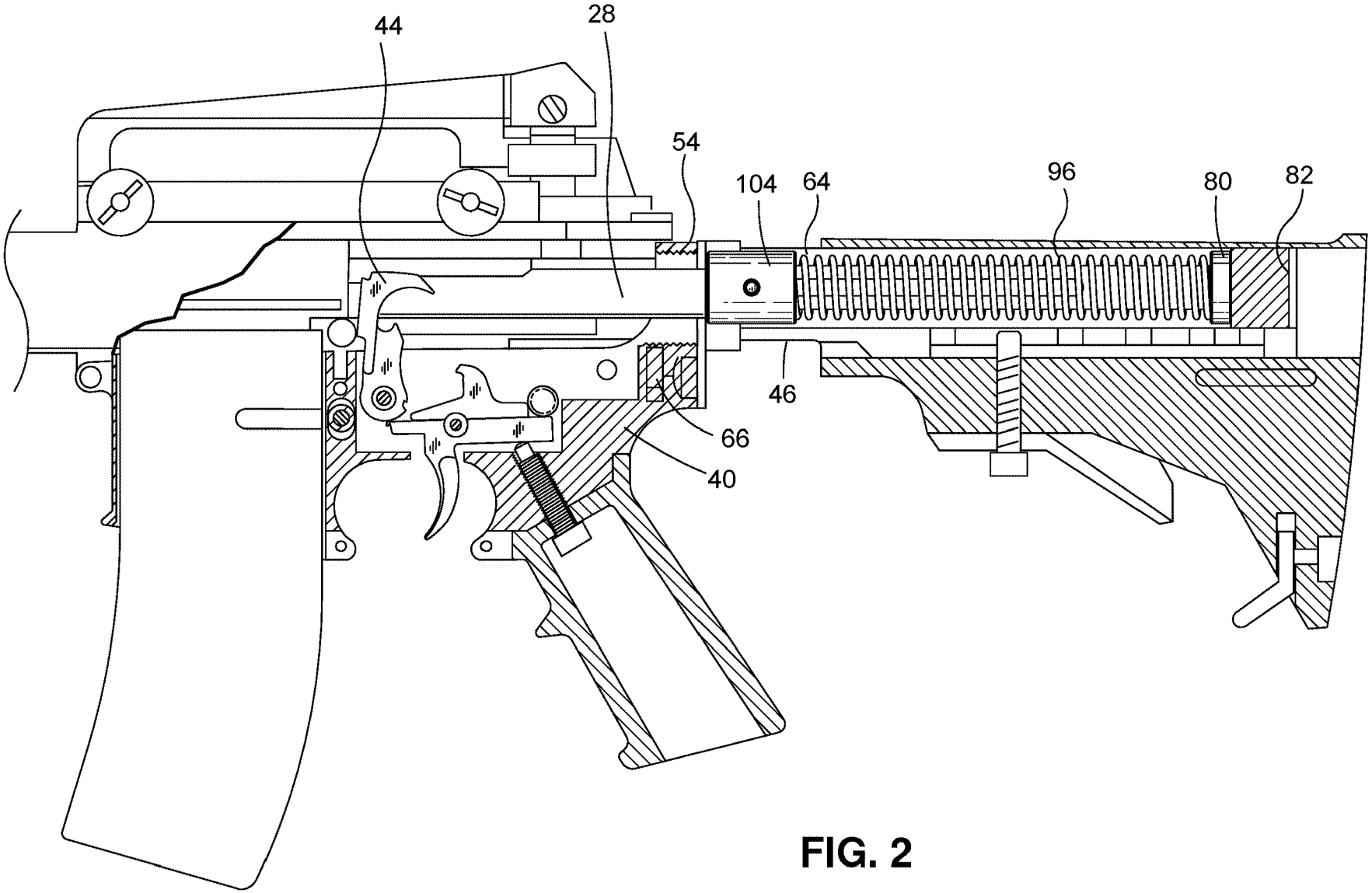
FIG. 2 is a detailed cross-sectional view of a lower receiver assembly, upper receiver assembly, and buffer extension tube with an embodiment of the recoil buffer assembly of the present disclosure inserted therein, the bolt and the recoil buffer assembly being in a forward position post/pre cycle.

With reference to the partial cross-sectional view of the firearm 10 shown in FIG. 2, the present disclosure contemplates a recoil buffer assembly 64 that differs substantially from the standard buffer and action spring configuration. The recoil buffer assembly 64 is envisioned to be a direct, drop-in replacement for the buffer and the action spring, and is sized and configured for placement in the buffer extension tube 46. As is standard in AR-15 pattern firearms, the lower receiver 40 includes an upwardly biased buffer retaining pin 66, which can be used to limit the further forward movement of the recoil buffer assembly 64 beyond the buffer tube receiver extension 54 of the lower receiver 40. The front end of the recoil buffer assembly 64 abuts against the rear end of the bolt carrier 28. The state of the firearm action shown in FIG. 2 is with the bolt/bolt carrier group 24 in the forward position and the hammer 44 likewise being in the forward or dropped position. This is a condition in which the firearm 10 has been rendered safe, as the forward hammer implies that no unfired ammunition cartridge has been chambered.

Figure 3:
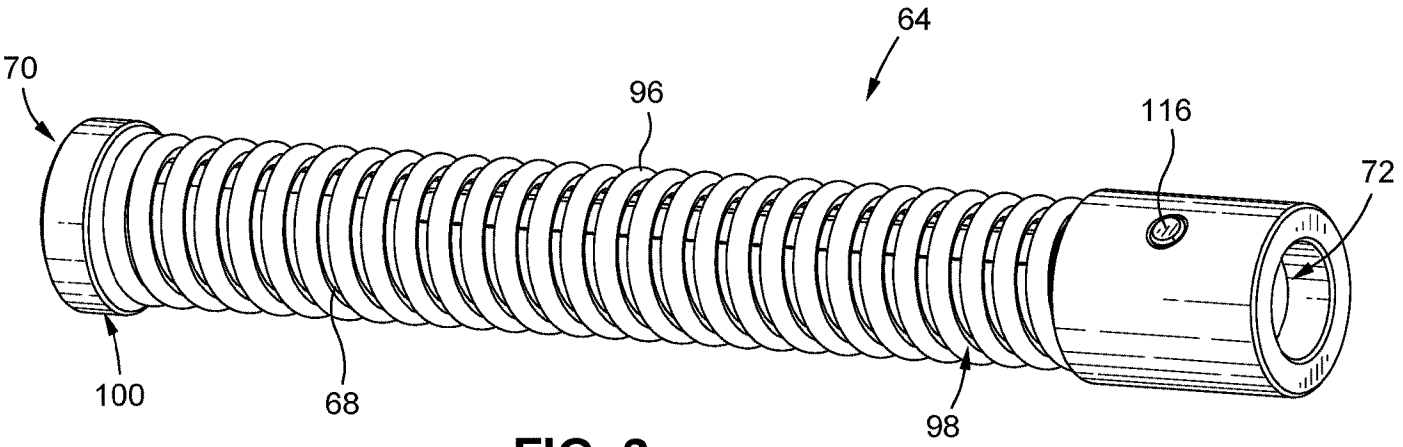
FIG. 3 is a perspective view of the recoil buffer assembly of the present disclosure.
Figure 4:
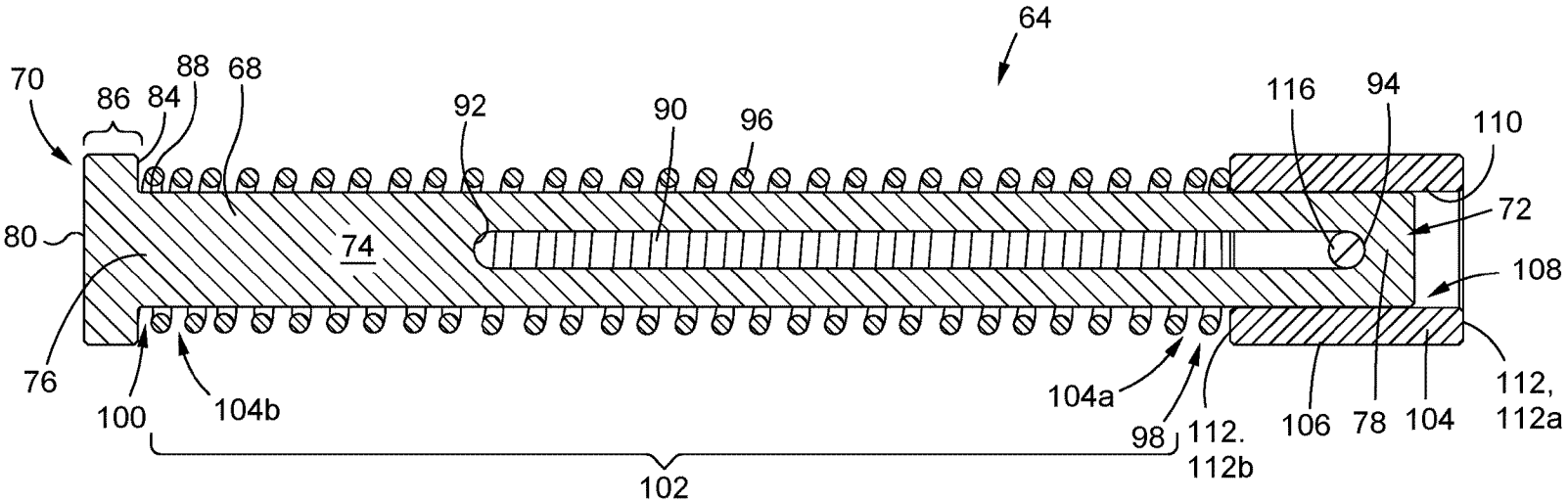
FIG. 4 is a detailed cross-sectional view of the recoil buffer assembly.

Referring now to FIG. 3 and FIG. 4, additional details of the recoil buffer assembly 64 will be described. The recoil buffer assembly 64, one embodiment of which may also be referred to as a captured spring recoil buffer, includes a rod 68 with a flanged rear end 70 and an opposed front end 72. Specifically, the rod 68 has a shaft portion 74 with an aft end section 76 that abuts against the flanged rear end 70, and a forward end section 78 that generally coincides with the front end 72 of the rod 68. In the exemplary embodiment, the flanged rear end 70 is contiguous and integrally constructed with the shaft portion 74, though this is by way of example only. It is also possible for the flanged rear end 70 to be a disk having a predetermined thickness and an axially centered attachment modality that couples with a corresponding element incorporated into the aft end section 76 of the shaft portion 74.

The recoil buffer assembly 64 is intended to be fitted into the buffer extension tube 50, so the diameter of the flanged rear end 70 is understood to substantially correspond to the inner diameter of the buffer extension tube 50. As utilized herein, such a correspondence between the inner diameter of one component and an outer diameter of another component is understood to refer to a relationship in which the inner component slides within the outer component without substantial resistance, or at least an extent of resistance that can be overcome with manual force. It is deemed to be within the purview of those having ordinary skill in the art to dimension and define tolerances of the flanged rear end 70 to a standardized inner diameter of the buffer extension tube 50.

The flanged rear end 70 is defined by a rear face 80 that is circular to conform to an interior face 82 of the buffer extension tube. Opposite the rear face 80 is a shoulder face 84 defined from an outer rim 86 to an outer cylindrical wall 88 of the shaft portion 74. The thickness of the outer rim 86 is exemplary only, and any suitable thickness to provide sufficient strength to maintain resiliency under the force of an action spring may be employed.

One embodiment of the rod 68, and in particular the shaft portion 74 thereof, may define a pin passage slot 90 that has an elongate configuration spanning between a rearward limit 92 and forward limit 94. As shown, the rear limit 92 is toward the aft end section 76 of the shaft portion 74, while the front limit 94 is toward the forward end section 78 of the shaft portion 84. The pin passage slot 90 has a depth extending the entirety of the diameter of the shaft portion 74. Additional details of the pin passage slot 90 and other components of the recoil buffer assembly 64 interrelated thereto will be described more fully below.

The recoil buffer assembly 64 further includes an action spring 96 that is fitted around the rod 68, and specifically the shaft portion 74 thereof. As with other elongate components, the action spring 96 is defined by a forward end 98 and an opposed rearward end 100. The rearward end 100 is understood to abut against the shoulder face 84 of the flanged rear end 70, and the action spring 94 exerts a biasing force against the same when under compression. Free and unrestricted movement of the action spring 96 relative to the outer cylindrical wall 88 of the shaft portion 74 is contemplated, so an inner diameter of the action spring 96 is understood to be slightly oversized compared to the outer diameter of the shaft portion 74. The outer diameter of the action spring 96, on the other hand, is contemplated to be less than or equal to the diameter of the flanged rear end, that is, it is not wider than the outer rim 86.

The action spring 96 may be comprised of a series of equally spaced primary coils 102 between one or more end coils 104. The forward end 98 of the action spring 94 includes a first set of end coils 104*a*, while the rearward end 100 of the action spring 94 includes a second set of end coils 104*b*. In a preferred, though optional embodiment, the spacing of the primary coils 102 is wider than the spacing of the end coils 104, that is, the end coils 104 are more tightly would or wound more closely than the primary coils 102. The spacing of the first set of end coils 104*a* may be the same as the second set of end coils 104*b*, though this is also optional. Where the first set of end coils 104*a* are spaced According to one embodiment, the action spring 94 is comprised of twenty-eight coils, and each coil has a circular cross section. This is by way of example only, as flat wire springs may or springs with any suitable number of coils may be readily substituted without departing from the scope of the present disclosure.

Figure 6:
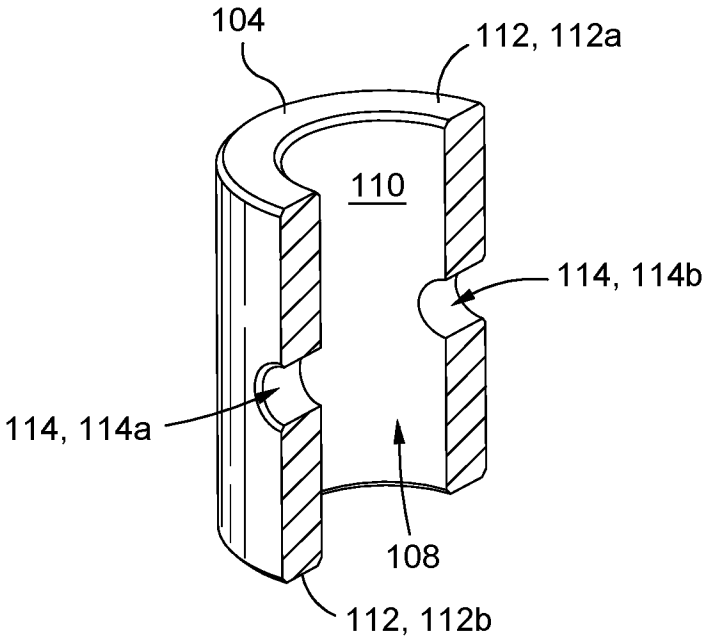
FIG. 6 is a cross-sectional perspective view of the buffer.
Figure 5:
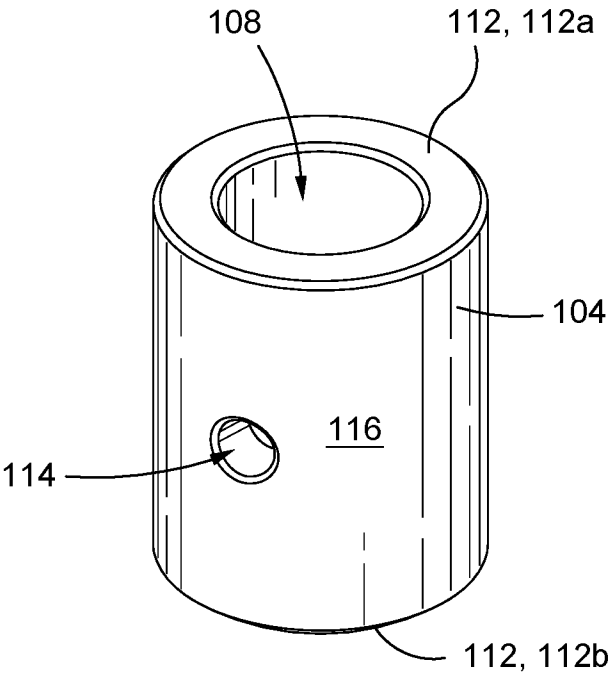
FIG. 5 is a perspective view of a buffer of the recoil buffer assembly in accordance with an embodiment of the present disclosure.

In abutting relationship to the forward end 98 of the action spring 96 is a buffer 104. With additional reference to FIGS. 5 and 6, the buffer 104 is defined by an outer cylindrical wall 106, and an axial bore 108. The buffer 104 therefore has an inner cylindrical wall 110, with two opposed annular lips 112, including a forward annular lip 112*a* and a rear annular lip 112*b*. The forward end 98 of the action spring 96 therefore abuts against the rear annular lip 112*b* of the buffer 104, with a biasing force being exerted against it when under compression. The action spring 96 therefore decelerates the rearward travel of the buffer 104, as well as the bolt carrier 28/bolt carrier group 24 to which it frictionally engaged. The shaft portion 74 passes through the axial bore 108, and, as such, the buffer 104 is in sliding engagement with the rod 68. The axial bore 108 and the shaft portion 74 are sized and shaped to permit free movement of the buffer 104. Accordingly, the outer diameter of the shaft portion 74 is understood to correspond to the inner diameter of the axial bore 108. The buffer 104 is contemplated to freely slide within the buffer extension tube 56, and so the outer diameter of the buffer 104 is sized to correspond to the inner diameter of the buffer extension tube 56. In some embodiments, the outer diameter of the buffer 104 is the same or substantially the same as the outer diameter of the flanged rear end 70. As noted above, those having ordinary skill in the art will recognize the appropriate size and tolerance of each of these components to allow for the freely sliding engagements described herein.

The buffer 104, and specifically the cylindrical sidewall 106 thereof, define aligned, crosswise pin openings 114 that are normal to the bore axis. There pin openings 114 may be centered with respect to the height of the buffer 104, with each opposing sidewall defining the first and second pin openings 114*a*, 114*b*, respectively. As illustrated in FIG. 3 and FIG. 4, inserted through the pin openings 114 is a dowel pin 116 that has an elongate cylindrical configuration and is press-fitted thereto. In this regard, the outer diameter of the dowel pin 116 is understood to correspond to the inner diameter of the crosswise pin openings 114.

With the buffer 104 coupled to the rod 68 in a sliding relationship, the dowel pin 116 is understood to extend through the first pin opening 114*a* of the buffer 104, then through the shaft portion 74 via the pin passage slot 90, and through the second pin opening 114*b*. This is understood to captively retain the action spring 96 between the rod 68 and the buffer 104. The length of the dowel pin 116 substantially corresponds to the diameter of the buffer 104 and is thus confined within the inner walls of the buffer extension tube 56 during movement. Therefore, unlike conventional captured spring configurations in which the various components are axially attached, this cross-wise securing of the buffer 104 to the rod 68 is not prone to loosening and abnormal wear therefrom.

When the buffer 104 travels to the rear, so does the dowel pin 116 travel through the pin passage slot 90. Thus, the diameter of the dowel pin 116 substantially corresponds to the width of the pin passage slot 90 to it to slide freely within. The opposed ends of the pin passage slot 90, that is, the rear limit 92 and the front limit 94, are radiused to accommodate the cylindrical outer wall of the dowel pin 116. The front limit 94 is receded from the front end 72 of the shaft portion 74 so that the buffer 104 is positioned beyond the same at full extension. In other words, the front end 72 is recessed within the axial bore 108 of the buffer 104 when it is in the forward position.

Figure 7:
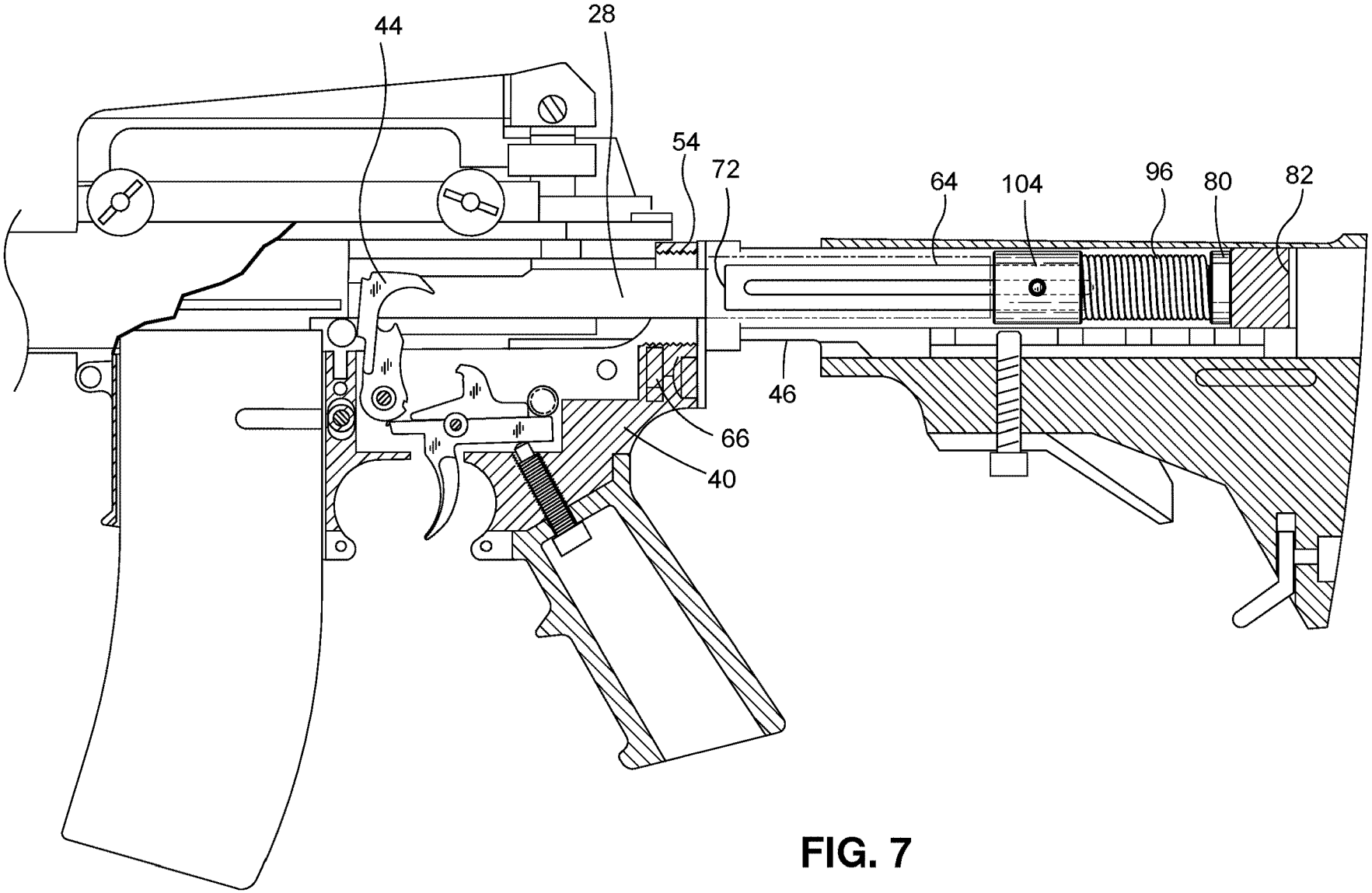
FIG. 7 is a detailed cross-sectional view of the lower receiver assembly, the upper receiver assembly, and the buffer extension tube with an embodiment of the recoil buffer assembly of the present disclosure inserted therein, the bolt and the recoil buffer assembly being in a rearward position mid-cycle.

As shown in the cross-sectional view of FIG. 7, the buffer 104 travels rearward together with the bolt carrier group 24 during the final cycling phases. The action spring 96 is compressed, and a portion of the bolt carrier 28 passes through the shaft portion 74. The length of the shaft portion 74 is such that at is fullest rearward position, an interior wall of the bolt carrier 28 does not make contact with the front end 72. Upon decelerating the buffer 104 and the bolt carrier group 24 to a point in which the biasing force of the action spring 96 is no longer being overcome, the expansive force of the same pushes the buffer 104 and the bolt carrier group 24 forward.

Because the action spring 96 has a diameter somewhat less than that of the buffer 104 and the flanged rear end 70, the contact of the action spring 96 with the inner wall of the buffer extension tube 56 is envisioned to be minimal. Together with the tight fitting to the shaft portion 74, vibration and noise during cycling (that is, compression and decompression of the action spring 96) is minimized.

The foregoing embodiment of the buffer 104 defining the pin openings 114, and the dowel pin 116 extending through the pin passage slot 90 is preferred, though optional. There may be some variations in which these aspects are eliminated such that the action spring 96 is no longer captively retained. The operator may simply omit the dowel pins 116 when reconfiguring the rifle 10, or variations of the recoil buffer assembly 64 without the pin opening 114, the dowel pin 116, or the pin passage slot defined on the shaft portion 74 may be provided.

The particulars shown herein are by way of example only for purposes of illustrative discussion and are presented in the cause of providing what is believed to be the most useful and readily understood description of the principles and conceptual aspects of the various embodiments of the recoil buffer assembly set forth in the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A captured spring recoil buffer, comprising:

a rod with a flanged rear end and a shaft defining a pin passage slot;

an action spring fitted around the rod and defined by a forward end and a rear end abutting against the flanged rear end of the rod;

a buffer with a cylindrical sidewall and defining an axial bore, the cylindrical sidewall defining a pair of aligned crosswise pin openings normal to the bore axis, the buffer being in sliding engagement with the rod and the forward end of the action spring abutting against the buffer; and a dowel pin positioned through the crosswise pin openings on the cylindrical sidewall of the buffer and through the pin passage slot of the shaft.

2. The recoil buffer of claim 1, wherein:

the shaft is defined by an aft end section integral with the flanged rear end, and an opposed forward end section; and the pin passage slot is elongate and extends along the shaft between the aft end section and the forward end section.

3. The recoil buffer of claim 1, wherein the flanged rear end and the shaft of the rod are of integral construction.

4. The recoil buffer of claim 1, wherein the action spring is defined at least by a plurality of equally spaced primary coils.

5. The recoil buffer of claim 4 wherein the forward end of the action spring is defined by a plurality of end coils having a shorter separation distance between each relative to the primary coils.

6. The recoil buffer of claim 4, wherein the rear end of the action spring is defined by end coils having a shorter separation distance between each relative to the primary coils.

7. The recoil buffer of claim 4, wherein an inner diameter of the primary coils substantially conforms to an outer diameter of the shaft.

8. The recoil buffer of claim 4, wherein an outer diameter of the primary coils is less than an outer diameter of the buffer and an outer diameter of the flanged rear end of the rod.

9. The recoil buffer of claim 1, wherein the pin passage slot has a width corresponding to a diameter of the dowel pin.

10. The recoil buffer of claim 1, wherein an inner diameter of the axial bore of the buffer corresponds substantially to an outer diameter of the shaft of the rod.

11. The recoil buffer of claim 1, wherein an outer diameter of the flanged rear end of the rod is equivalent an outer diameter of the buffer.

12. The recoil buffer of claim 1, wherein a length of the dowel pin is substantially the same as an outer diameter of the buffer.

13. A firearm recoil buffer assembly, comprising:

a rod with a flanged rear end and a shaft extending therefrom;

an action spring fitted around the rod and defined by a forward end and a rear end abutting against the flanged rear end of the rod; and a buffer with a cylindrical sidewall defining an axial bore and a pair of aligned crosswise pin openings, the buffer being in sliding engagement with the rod and the forward end of the action spring abutting against the buffer.

14. The firearm recoil buffer assembly of claim 13, wherein the shaft of the rod defines a pin passage slot.

15. The firearm recoil buffer assembly of claim 13, further comprising:

a dowel pin positioned through the crosswise pin openings on the cylindrical sidewall of the buffer and through the pin passage slot of the shaft.

16. The firearm recoil buffer assembly of claim 13, wherein:

the action spring is defined at least by a plurality of equally spaced primary coils;

the forward end of the action spring is defined by a plurality of end coils having a shorter separation distance between each relative to the primary coils; and the rear end of the action spring is defined by end coils having a shorter separation distance between each relative to the primary coils.

17. The firearm recoil buffer assembly of claim 13, wherein the flanged rear end and the shaft of the rod are of integral construction.

18. The firearm recoil buffer assembly of claim 13, wherein an inner diameter of the primary coils substantially conforms to an outer diameter of the shaft.

19. The firearm recoil buffer assembly of claim 13 wherein an outer diameter of the primary coils is less than an outer diameter of the buffer and an outer diameter of the flanged rear end of the rod.

* * * * *